US010194694B2

(12) United States Patent
Davis et al.

(10) Patent No.: US 10,194,694 B2
(45) Date of Patent: Feb. 5, 2019

(54) AEROSOL DELIVERY DEVICE WITH IMPROVED FLUID TRANSPORT

(71) Applicant: R.J. Reynolds Tobacco Company, Winston-Salem, NC (US)

(72) Inventors: Michael F. Davis, Clemmons, NC (US); Ercilia Hernandez Garcia, Clayton, NC (US); Sawyer Hubbard, Winston-Salem, NC (US); Percy D. Phillips, Pfafftown, NC (US); James William Rogers, Winston-Salem, NC (US); Stephen Benson Sears, Siler City, NC (US); Andries Don Sebastian, Clemmons, NC (US); Karen V. Taluskie, Winston-Salem, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 317 days.

(21) Appl. No.: 14/988,109

(22) Filed: Jan. 5, 2016

(65) Prior Publication Data

US 2017/0188626 A1 Jul. 6, 2017

(51) Int. Cl.
*F24F 6/08* (2006.01)
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 3,200,819 | A | 8/1965 | Gilbert |
| 4,284,089 | A | 8/1981 | Ray |
| 4,303,083 | A | 12/1981 | Burruss, Jr. |
| 4,735,217 | A | 4/1988 | Gerth et al. |
| 4,848,374 | A | 7/1989 | Chard et al. |
| 4,907,606 | A | 3/1990 | Lilja et al. |
| 4,922,901 | A | 5/1990 | Brooks et al. |
| 4,945,931 | A | 8/1990 | Gori |
| 4,947,874 | A | 8/1990 | Brooks et al. |
| 4,947,875 | A | 8/1990 | Brooks et al. |
| 4,986,286 | A | 1/1991 | Roberts et al. |

(Continued)

FOREIGN PATENT DOCUMENTS

| | | |
|---|---|---|
| AU | 276250 | 7/1965 |
| CA | 2 641 869 | 5/2010 |

(Continued)

*Primary Examiner* — Thor Campbell
(74) *Attorney, Agent, or Firm* — Womble Bond Dickinson (US) LLP

(57) ABSTRACT

The present disclosure relates to aerosol delivery devices, methods of forming such devices, and elements of such devices. In some embodiments, the present disclosure provides devices configured for vaporization of an aerosol precursor composition that is stored in and/or transported to a heater by a porous monolith, which can be, for example, a porous glass or a porous ceramic. A heater can be in a heating arrangement with an external portion of the porous monolith or can be substantially internal to the porous monolith.

17 Claims, 6 Drawing Sheets

(56) References Cited

U.S. PATENT DOCUMENTS 5,019,122 A 5/1991 Clearman et al.
5,042,510 A 8/1991 Curtiss et al.
5,060,671 A 10/1991 Counts et al.
5,093,894 A 3/1992 Deevi et al.
5,144,962 A 9/1992 Counts et al.
5,249,586 A 10/1993 Morgan et al.
5,261,424 A 11/1993 Sprinkel, Jr.
5,322,075 A 6/1994 Deevi et al.
5,353,813 A 10/1994 Deevi et al.
5,369,723 A 11/1994 Counts et al.
5,372,148 A 12/1994 McCafferty et al.
5,388,574 A 2/1995 Ingebrethsen et al.
5,408,574 A 4/1995 Deevi et al.
5,468,936 A 11/1995 Deevi et al.
5,498,850 A 3/1996 Das
5,515,842 A 5/1996 Ramseyer et al.
5,530,225 A 6/1996 Hajaligol
5,564,442 A 10/1996 MacDonald et al.
5,649,554 A 7/1997 Sprinkel et al.
5,666,977 A 9/1997 Higgins et al.
5,687,746 A 11/1997 Rose et al.
5,726,421 A 3/1998 Fleischhauer et al.
5,727,571 A 3/1998 Meiring et al.
5,743,251 A 4/1998 Howell et al.
5,799,663 A 9/1998 Gross et al.
5,819,756 A 10/1998 Mielordt
5,865,185 A 2/1999 Collins et al.
5,865,186 A 2/1999 Volsey, II
5,878,752 A 3/1999 Adams et al.
5,894,841 A 4/1999 Voges
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,125,853 A 10/2000 Susa et al.
6,155,268 A 12/2000 Takeuchi
6,164,287 A 12/2000 White
6,196,218 B1 3/2001 Voges
6,196,219 B1 3/2001 Hess et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,772,756 B2 8/2004 Shayan
6,803,545 B2 10/2004 Blake et al.
6,854,461 B2 2/2005 Nichols
6,854,470 B1 2/2005 Pu
7,117,867 B2 10/2006 Cox et al.
7,293,565 B2 11/2007 Griffin et al.
7,513,253 B2 4/2009 Kobayashi et al.
7,694,675 B2 * 4/2010 Koch ..... A61M 16/1075 128/203.16
7,775,459 B2 8/2010 Martens, III et al.
7,832,410 B2 11/2010 Hon
7,845,359 B2 12/2010 Montaser
7,896,006 B2 3/2011 Hamano et al.
7,992,554 B2 * 8/2011 Radomski ..... A61M 16/16 128/203.12
8,127,772 B2 3/2012 Montaser
8,314,591 B2 11/2012 Terry et al.
8,365,742 B2 2/2013 Hon
8,402,976 B2 3/2013 Fernando et al.
8,499,766 B1 8/2013 Newton
8,528,569 B1 9/2013 Newton
8,550,069 B2 10/2013 Alelov
2002/0136542 A1 * 9/2002 He ..... A61L 9/037 392/395
2002/0146242 A1 10/2002 Vieira
2003/0226837 A1 12/2003 Blake et al.
2004/0118401 A1 6/2004 Smith et al.
2004/0129280 A1 7/2004 Woodson et al.
2004/0200488 A1 10/2004 Felter et al.
2004/0226568 A1 11/2004 Takeuchi et al.
2005/0016550 A1 1/2005 Katase
2006/0016453 A1 1/2006 Kim
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2008/0085103 A1 4/2008 Beland et al.
2008/0092912 A1 4/2008 Robinson et al.
2008/0257367 A1 10/2008 Paterno et al.
2008/0276947 A1 11/2008 Martzel
2008/0302374 A1 12/2008 Wengert et al.
2009/0095311 A1 4/2009 Hon
2009/0095312 A1 4/2009 Herbrich et al.
2009/0126745 A1 * 5/2009 Hon ..... A24F 47/008 131/273
2009/0188490 A1 7/2009 Hon
2009/0230117 A1 9/2009 Fernando et al.
2009/0272379 A1 11/2009 Thorens et al.
2009/0283103 A1 11/2009 Nielsen et al.
2009/0320863 A1 12/2009 Fernando et al.
2010/0031968 A1 2/2010 Sheikh et al.
2010/0043809 A1 2/2010 Magnon
2010/0083959 A1 4/2010 Siller
2010/0200006 A1 8/2010 Robinson et al.
2010/0229881 A1 9/2010 Hearn
2010/0242974 A1 9/2010 Pan
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0094523 A1 4/2011 Thorens et al.
2011/0126848 A1 6/2011 Zuber et al.
2011/0155153 A1 * 6/2011 Thorens ..... H05B 3/58 131/329
2011/0155718 A1 6/2011 Greim et al.
2011/0168194 A1 7/2011 Hon
2011/0265806 A1 11/2011 Alarcon et al.
2011/0277757 A1 11/2011 Terry et al.
2011/0290248 A1 12/2011 Schennum
2011/0309157 A1 12/2011 Yang et al.
2012/0042885 A1 2/2012 Stone et al.
2012/0060853 A1 3/2012 Robinson et al.
2012/0111347 A1 5/2012 Hon
2012/0132643 A1 5/2012 Choi et al.
2012/0227752 A1 9/2012 Alelov
2012/0231464 A1 9/2012 Yu et al.
2012/0260927 A1 10/2012 Liu
2012/0279512 A1 * 11/2012 Hon ..... A24F 47/008 131/329
2012/0318882 A1 12/2012 Abehasera
2013/0037041 A1 * 2/2013 Worm ..... A24F 47/008 131/329
2013/0056013 A1 3/2013 Terry et al.
2013/0081625 A1 4/2013 Rustad et al.
2013/0081642 A1 4/2013 Safari
2013/0192619 A1 * 8/2013 Tucker ..... H01C 17/00 131/329
2013/0255702 A1 * 10/2013 Griffith, Jr. ..... A24F 47/008 131/328
2013/0298905 A1 11/2013 Levin et al.
2013/0306084 A1 11/2013 Flick
2013/0319439 A1 12/2013 Gorelick et al.
2013/0340750 A1 12/2013 Thorens et al.
2013/0340775 A1 12/2013 Juster et al.
2014/0000638 A1 1/2014 Sebastian et al.
2014/0060554 A1 3/2014 Collett et al.
2014/0060555 A1 3/2014 Chang et al.
2014/0096781 A1 4/2014 Sears et al.
2014/0096782 A1 4/2014 Ampolini et al.
2014/0109921 A1 4/2014 Chen
2014/0157583 A1 6/2014 Ward et al.
2014/0209105 A1 7/2014 Sears et al.
2014/0253144 A1 9/2014 Novak et al.
2014/0261408 A1 9/2014 DePiano et al.
2014/0261486 A1 9/2014 Potter et al.
2014/0261487 A1 9/2014 Chapman et al.

(56) References Cited

U.S. PATENT DOCUMENTS

| | | | | |
|---|---|---|---|---|
| 2014/0261495 | A1* | 9/2014 | Novak, III | A24F 47/008 131/329 |
| 2014/0270727 | A1 | 9/2014 | Ampolini et al. | |
| 2014/0270729 | A1 | 9/2014 | DePiano et al. | |
| 2014/0270730 | A1* | 9/2014 | DePiano | A24F 47/008 392/404 |
| 2014/0345631 | A1 | 11/2014 | Bowen et al. | |
| 2015/0053217 | A1 | 2/2015 | Steingraber et al. | |
| 2015/0059780 | A1 | 3/2015 | Davis et al. | |
| 2016/0021930 | A1* | 1/2016 | Minskoff | A61M 15/06 131/329 |
| 2016/0183598 | A1* | 6/2016 | Tucker | H01C 17/00 392/395 |

FOREIGN PATENT DOCUMENTS

| | | |
|---|---|---|
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1 618 803 | 1/2006 |
| EP | 2 316 286 | 5/2011 |
| GB | 2469850 | 11/2010 |
| WO | WO 1997/48293 | 12/1997 |
| WO | WO 2003/034847 | 5/2003 |
| WO | WO 2004/043175 | 5/2004 |
| WO | WO 2004/080216 | 9/2004 |
| WO | WO 2005/099494 | 10/2005 |
| WO | WO 2007/078273 | 7/2007 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/073122 | 7/2010 |
| WO | WO 2010/118644 | 10/2010 |
| WO | WO 2010/140937 | 12/2010 |
| WO | WO 2011/010334 | 1/2011 |
| WO | WO 2012/072762 | 6/2012 |
| WO | WO 2012/100523 | 8/2012 |
| WO | WO 2013/089551 | 6/2013 |

* cited by examiner

AEROSOL DELIVERY DEVICE WITH IMPROVED FLUID TRANSPORT

FIELD OF THE DISCLOSURE

The present disclosure relates to aerosol delivery devices such as smoking articles, and more particularly to aerosol delivery devices that may utilize electrically generated heat for the production of aerosol (e.g., smoking articles commonly referred to as electronic cigarettes). The smoking articles may be configured to heat an aerosol precursor, which may incorporate materials that may be made or derived from tobacco or otherwise incorporate tobacco, the precursor being capable of forming an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices, and heat generating sources set forth in the background art described in U.S. Pat. No. 7,726,320 to Robinson et al., U.S. Pat. Pub. No. 2013/0255702 to Griffith Jr. et al., and U.S. Pat. Pub. No. 2014/0096781 to Sears et al., which are incorporated herein by reference. See also, for example, the various types of smoking articles, aerosol delivery devices, and electrically powered heat generating sources referenced by brand name and commercial source in U.S. Pat. Pub. No. 2015/0216236 to Bless et al., filed Feb. 3, 2014, which is incorporated herein by reference.

It would be desirable to provide a reservoir for an aerosol precursor composition for use in an aerosol delivery device, the reservoir being provided so as to improve formation of the aerosol delivery device. It would also be desirable to provide aerosol delivery devices that are prepared utilizing such reservoirs.

SUMMARY OF THE DISCLOSURE

The present disclosure relates to aerosol delivery devices, methods of forming such devices, and elements of such devices. The aerosol delivery devices can incorporate one or more components or elements formed of a porous monolithic material. In one or more embodiments, the porous monolithic material can comprise a porous glass. In particular, porous glass can be utilized as one or both of a reservoir and a liquid transport element. In one or more further embodiments, the porous monolithic material can comprise a porous ceramic. In particular, porous ceramic can be utilized as one or both of a reservoir and a liquid transport element.

In one or more aspects, the present disclosure thus can provide an aerosol delivery device comprising: an outer housing; a reservoir containing a liquid; a heater configured to vaporize the liquid; and a liquid transport element configured to provide the liquid to the heater. In particular, one or both of the liquid transport element and the reservoir is formed of a porous monolith, which can be one or both of a porous glass and a porous ceramic. In one or more embodiments, the aerosol delivery device can be defined in relation to the following statements, which are non-limiting and can be combined in any number and/or order.

The heater can be printed on the liquid transport element or annealed to the liquid transport element.

The heater can be in a heating arrangement with an external portion of the liquid transport element.

The heater can be in a radiant heating arrangement with the liquid transport element.

At least a portion of the liquid transport element can be substantially planar, and the heater can be at least partially positioned on the substantially planar portion of the liquid transport element.

The liquid transport element and the reservoir can be both formed of porous glass.

The liquid transport element and the reservoir can be both formed of porous ceramic.

One of the liquid transport element and the reservoir can be formed of porous glass and the other of the liquid transport element and the reservoir can be formed of porous ceramic.

The reservoir and the liquid transport element can be a unitary element.

The reservoir can have a first porosity, and the liquid transport element can have a second porosity that is different from the first porosity.

The porous glass can comprise one or more etchings.

The porous ceramic can comprise one or more etchings.

The liquid transport element can be formed of porous glass, and the liquid transport element can be substantially cylindrical.

The liquid transport element can be formed of porous ceramic, and the liquid transport element can be substantially cylindrical.

The heater can be a wire that is wrapped around at least a portion of the liquid transport element.

The reservoir can be formed of porous glass, and the liquid transport element can be a fibrous wick.

The reservoir can be formed of porous ceramic, and the liquid transport element can be a fibrous wick.

The reservoir can be formed of a fibrous material, and the liquid transport element can be a porous glass.

The reservoir can be formed of a fibrous material, and the liquid transport element can be a porous ceramic.

The reservoir can be substantially shaped as a cylinder having a wall.

One or more portions of the fibrous wick can be in fluid connection with the reservoir wall.

The reservoir wall can include one or more grooves.

The grooves can have a porosity that is different from the porosity of the remaining portions of the reservoir wall.

The reservoir can be substantially shaped as a hollow cylinder.

The liquid transport element can comprise a core and a shell.

The shell can be formed of porous glass.

The shell can be formed of porous ceramic.

The core can be formed of a fibrous material.

The porous glass or porous ceramic shell can have opposing ends, and the core of the liquid transport element can extend beyond the opposing ends of the porous glass or porous ceramic shell.

The heater can be a wire and can be wrapped around at least a portion of the porous glass or porous ceramic shell.

The outer housing can comprise an air entry and can comprise a mouthend with an aerosol port.

The device further can comprise one or more of an electrical power source, a pressure sensor, and a microcontroller.

One or more of the electrical power source, the pressure sensor, and the microcontroller can be positioned within a separate control housing that is connectable with the outer housing.

In one or more aspects, the present disclosure can relate to an atomizer that can be particularly suitable for use in an aerosol delivery device. In exemplary embodiments, an atomizer can comprise a substantially planar porous monolith vapor substrate configured for transport of a liquid aerosol precursor composition and a heater in a heating arrangement with the substantially planar porous monolith vapor substrate. In one or more embodiments, the atomizer can be defined in relation to the following statements, which are non-limiting and can be combined in any number and/or order.

The porous monolith vapor substrate can be a porous glass.

The porous monolith vapor substrate can be a porous ceramic.

The atomizer can comprise a porous glass reservoir connected to a substantially planar porous glass vapor substrate.

The substantially planar porous glass vapor substrate can have a first porosity, and the porous glass reservoir can have a second porosity that is different form the first porosity.

One or both of the substantially planar porous glass vapor substrate and the porous glass reservoir can include one or more etchings.

The atomizer can comprise a porous ceramic reservoir connected to a substantially planar porous ceramic vapor substrate.

The atomizer can comprise a porous glass reservoir connected to a substantially planar porous ceramic vapor substrate.

The atomizer can comprise a porous ceramic reservoir connected to a substantially planar porous glass vapor substrate.

In one or more aspects, the present disclosure can relate to fluid transport element that can be particularly suitable for use in an aerosol delivery device. In exemplary embodiments, a liquid transport element can comprise an elongated core having a length and being formed of a wicking material and a shell surrounding the elongated core along at least of a portion of the length thereof, the shell being formed of a porous monolith, which can be a porous glass or a porous ceramic. In particular, the wicking material can be a fibrous material.

BRIEF DESCRIPTION OF THE FIGURES

Figure 1:
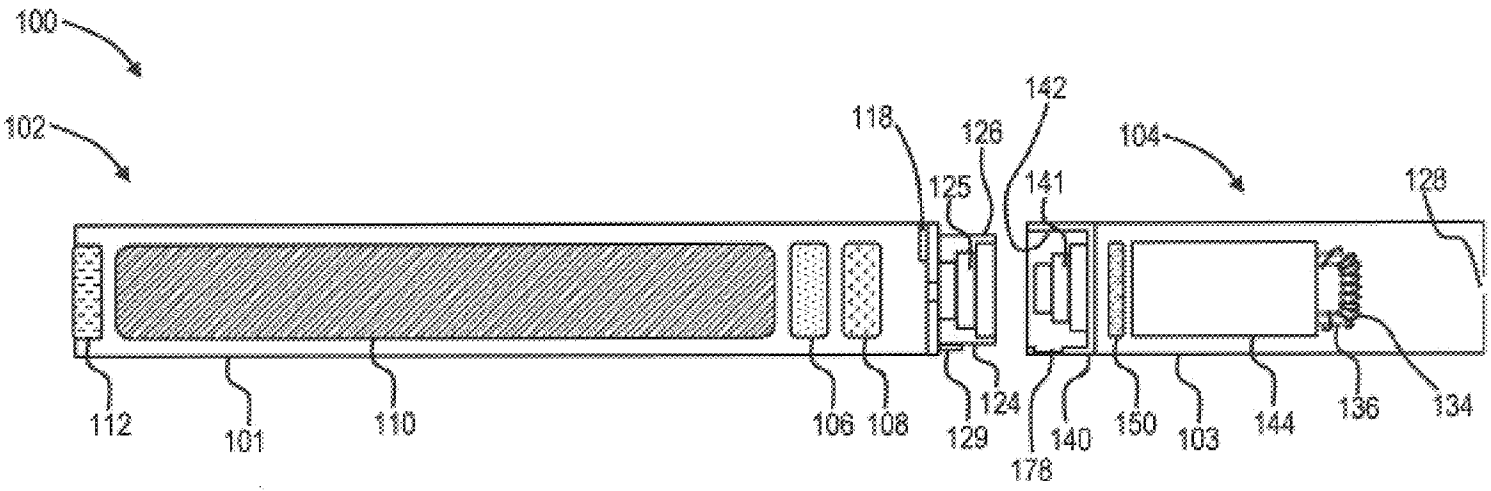
Figure 2:
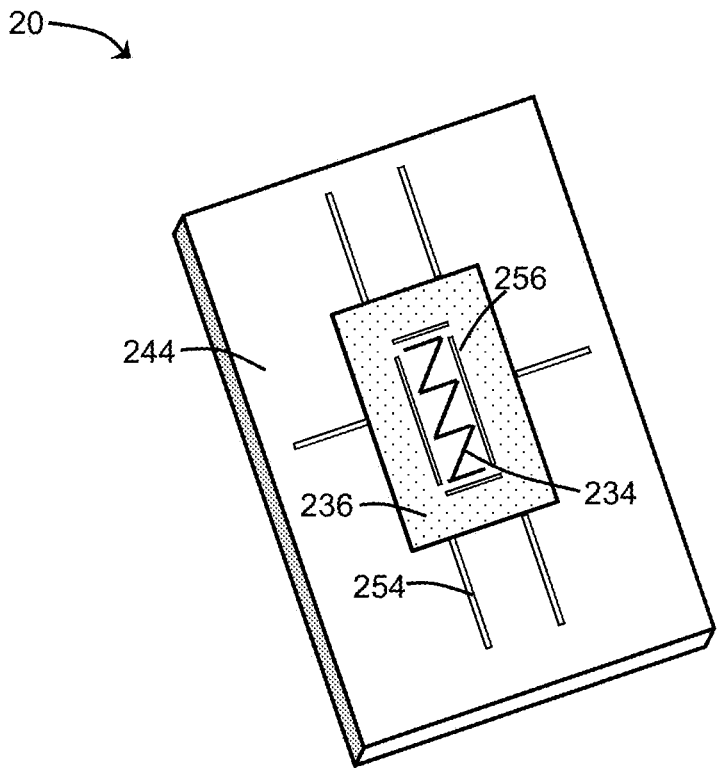
Figure 3:
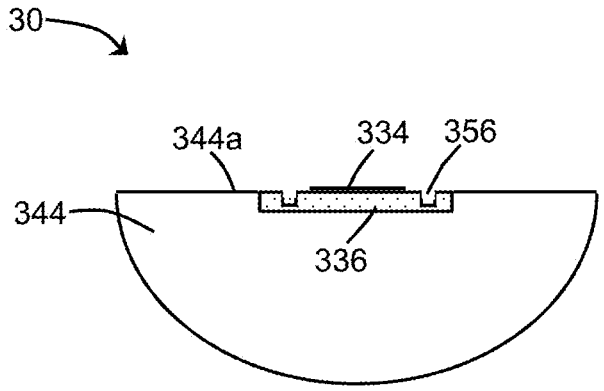
Figure 4:
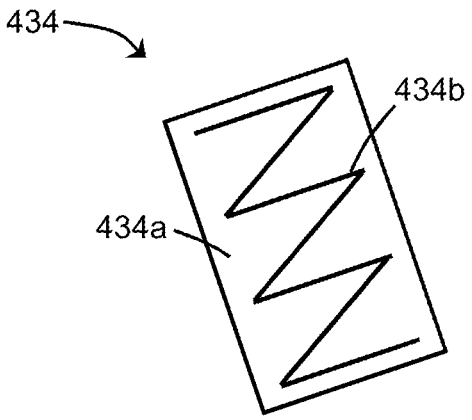
Figure 5:
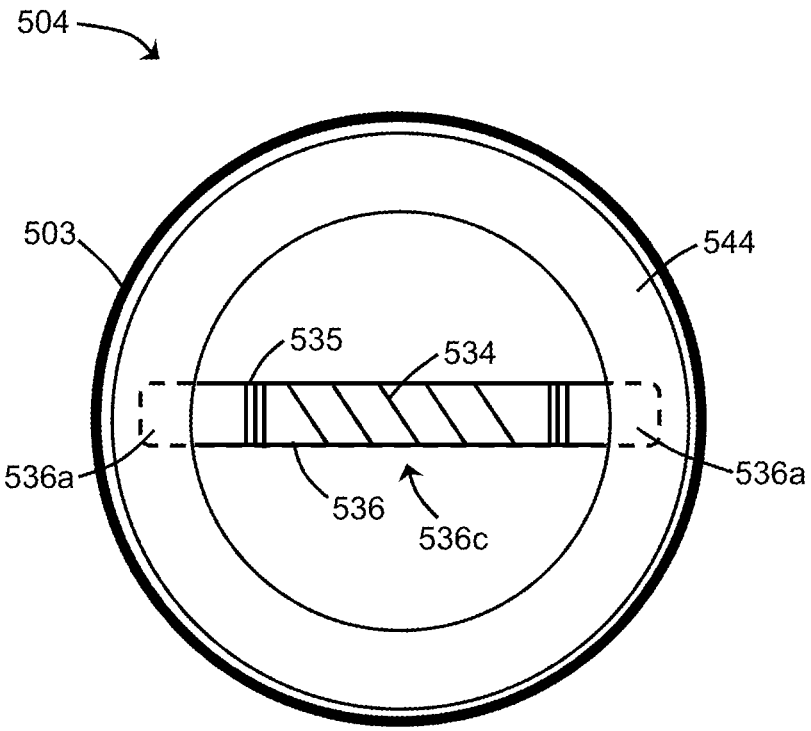
Figure 6:
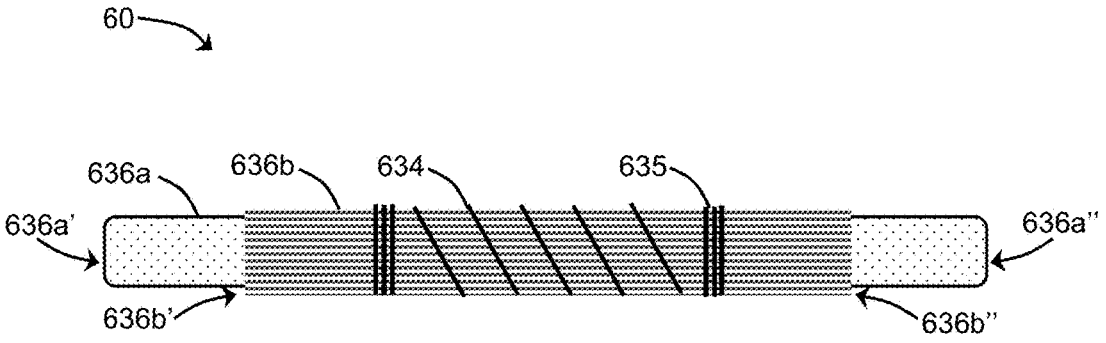
Figure 7A:
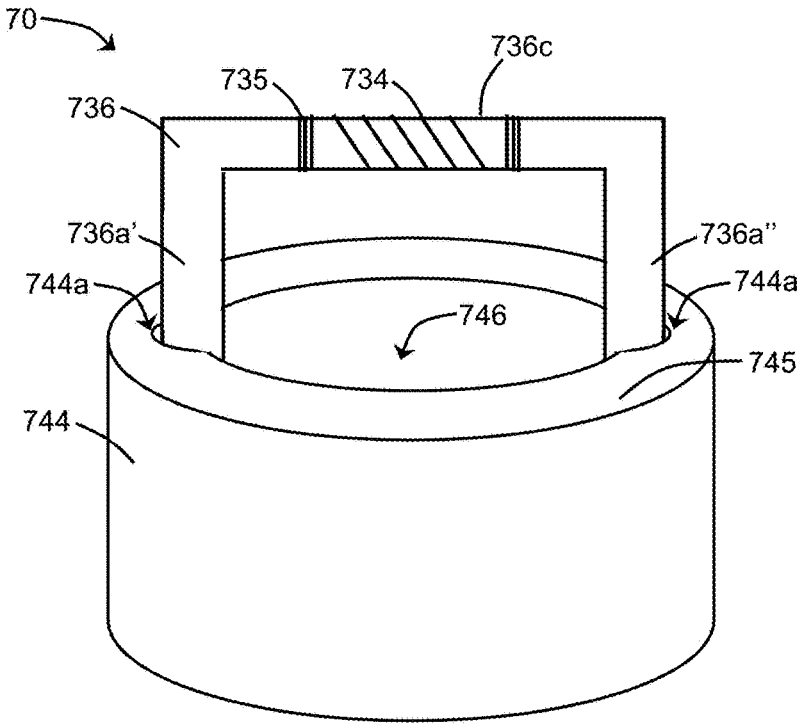
Figure 7B:
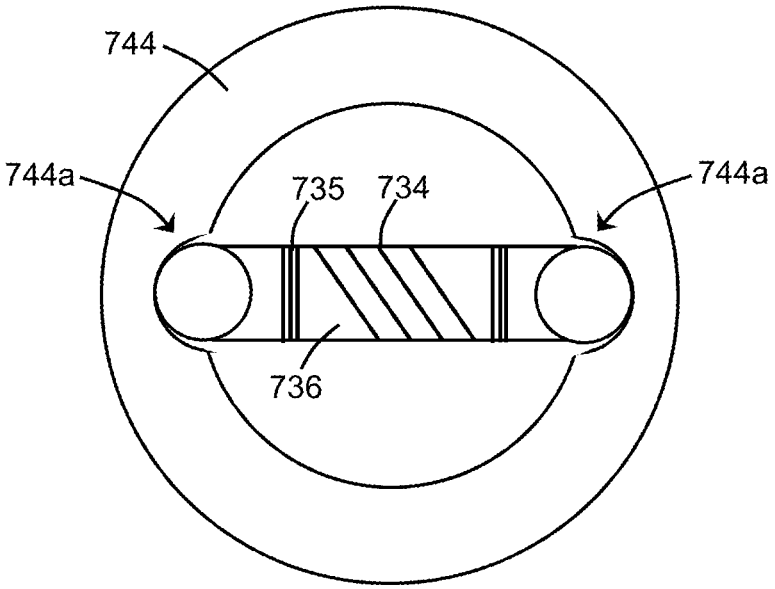

Having thus described the disclosure in the foregoing general terms, reference will now be made to the accompanying drawings, which are not necessarily drawn to scale, and wherein:

FIG. 1 is a partially cut-away view of an aerosol delivery device comprising a cartridge and a control body including a variety of elements that may be utilized in an aerosol delivery device according to various embodiments of the present disclosure;

FIG. 2 is a perspective view an atomizer according to one or more embodiments of the present disclosure including a reservoir and a liquid transport element that are one or both formed of a porous monolith, including porous glass and/or porous ceramic;

FIG. 3 is a partial cross-section of an atomizer according to one or more embodiments of the present disclosure including a reservoir and a liquid transport element that are one or both formed of a porous monolith, including porous glass and/or porous ceramic;

FIG. 4 is a perspective view of a heater that may be used according to one or more embodiments of the present disclosure;

FIG. 5 is a partial cross-section of a cartridge according to one or more embodiments of the present disclosure including a reservoir and a porous monolith liquid transport element with a heater wire in a heating arrangement with an external portion of the liquid transport element;

FIG. 6 illustrates a core/shell liquid transport element according to one or more embodiments of the present disclosure having a shell formed of a porous monolith and a core that optionally is formed of a porous monolith or a different wicking material;

FIG. 7*a* is a perspective view of an atomizer according to one or more embodiments of the present disclosure including a reservoir formed of a porous monolith substantially in the shape of a walled cylinder and having a liquid transport element combined therewith;

FIG. 7*b* is a bottom view of the atomizer of FIG. 7*a;*

Figure 8:
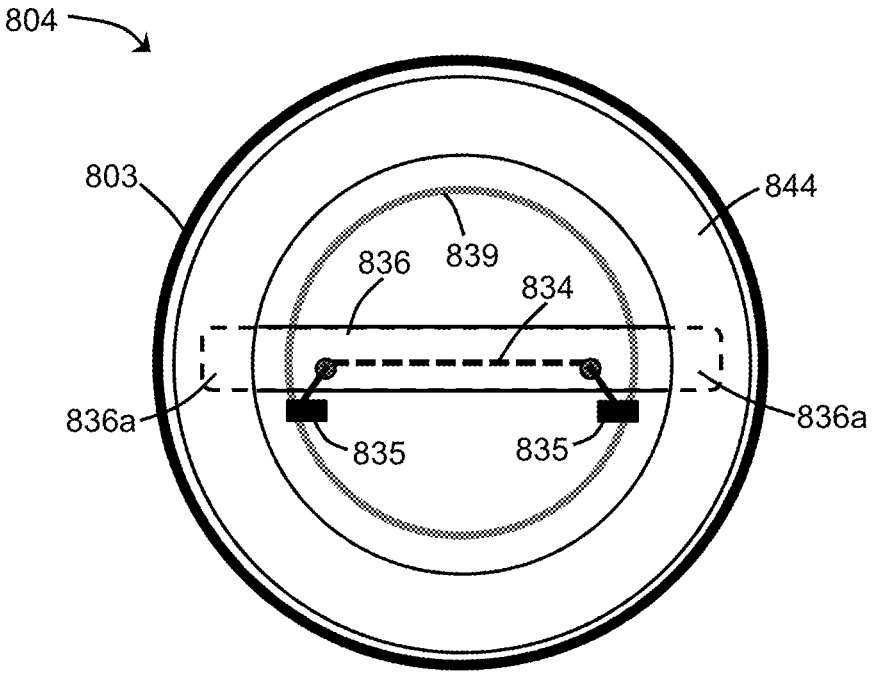
Figure 9A:
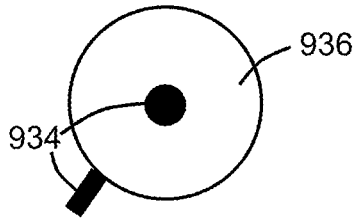
Figure 9B:
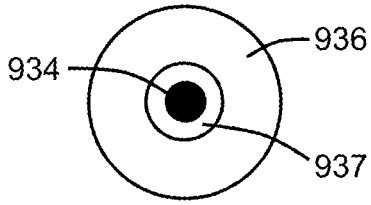
Figure 9C:
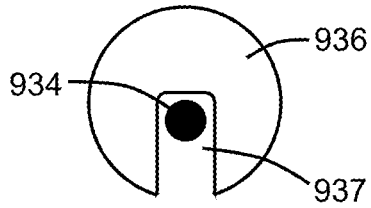

FIG. 8 is a partial cross-section of a cartridge according to one or more embodiments of the present disclosure including a reservoir and a porous monolith liquid transport element with a heater wire in a heating arrangement with an internal portion of the liquid transport element;

FIG. 9*a* is a cross-section of a liquid transport element with a heater embedded therein;

FIG. 9*b* is a cross-section of a liquid transport element substantially in the form of a hollow tube with a heater present in a cavity of the hollow tube; and FIG. 9*c* is a cross-section of a liquid transport element with a heater present in a cavity that is substantially in the form of a channel.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

As described hereinafter, embodiments of the present disclosure relate to aerosol delivery systems. Aerosol delivery systems according to the present disclosure use electrical energy to heat a material (preferably without combusting the material to any significant degree and/or without significant chemical alteration of the material) to form an inhalable substance; and components of such systems have the form of articles that most preferably are sufficiently compact to be considered hand-held devices. That is, use of components of preferred aerosol delivery systems does not result in the production of smoke—i.e., from by-products of combustion or pyrolysis of tobacco, but rather, use of those preferred systems results in the production of vapors/aerosols resulting from volatilization or vaporization of certain components incorporated therein. In preferred embodiments, components of aerosol delivery systems may be characterized as electronic cigarettes, and those electronic cigarettes most preferably incorporate tobacco and/or components derived from tobacco, and hence deliver tobacco derived components in aerosol form.

Aerosol generating pieces of certain preferred aerosol delivery systems may provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol generating piece of the present disclosure can hold and use that piece much like a smoker employs a traditional type of smoking article, draw on one end of that piece for inhalation of aerosol produced by that piece, take or draw puffs at selected intervals of time, and the like. The devices described herein, however, are not limited to devices that are substantially shaped and dimensioned as a traditional cigarette. Rather, the present devices may take on any shape and can be substantially larger than a traditional cigarette.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. In exemplary embodiments, an elongated body resembling the shape of a cigarette or cigar can be a formed from a single, unitary housing, or the elongated housing can be formed of two or more separable bodies. For example, an aerosol delivery device can comprise an elongated shell or body that can be substantially tubular in shape and, as such, resemble the shape of a conventional cigarette or cigar. In one embodiment, all of the components of the aerosol delivery device are contained within one housing. Alternatively, an aerosol delivery device can comprise two or more housings that are joined and are separable. For example, an aerosol delivery device can possess at one end a control body comprising a housing containing one or more components (e.g., a battery and various electronics for controlling the operation of that article), and at the other end and removably attached thereto an outer body or shell containing aerosol forming components (e.g., one or more aerosol precursor components, such as flavors and aerosol formers, one or more heaters, and/or one or more wicks).

Aerosol delivery devices of the present disclosure can be formed of an outer housing or shell that is not substantially tubular in shape but may be formed to substantially greater dimensions—i.e., be substantially "palm-sized" for being held in the palm of a user. The housing or shell can be configured to include a mouthpiece and/or may be configured to receive a separate shell (e.g., a cartridge) that can include consumable elements, such as a liquid aerosol former, and can include a vaporizer or atomizer.

Aerosol delivery devices of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., a microcontroller or microprocessor), a heater or heat generation member (e.g., an electrical resistance heating element or other component, which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthpiece or mouth region for allowing draw upon the aerosol delivery device for aerosol inhalation (e.g., a defined airflow path through the article such that aerosol generated can be withdrawn therefrom upon draw).

More specific formats, configurations and arrangements of components within the aerosol delivery systems of the present disclosure will be evident in light of the further disclosure provided hereinafter. Additionally, the selection and arrangement of various aerosol delivery system components can be appreciated upon consideration of the commercially available electronic aerosol delivery devices, such as those representative products referenced in background art section of the present disclosure.

One example embodiment of an aerosol delivery device 100 illustrating components that may be utilized in an aerosol delivery device according to the present disclosure is provided in FIG. 1. As seen in the cut-away view illustrated therein, the aerosol delivery device 100 can comprise a control body 102 and a cartridge 104 that can be permanently or detachably aligned in a functioning relationship. Engagement of the control body 102 and the cartridge 104 can be press fit (as illustrated), threaded, interference fit, magnetic, or the like. In particular, connection components, such as further described herein may be used. For example, the control body may include a coupler that is adapted to engage a connector on the cartridge.

In specific embodiments, one or both of the control body 102 and the cartridge 104 may be referred to as being disposable or as being reusable. For example, the control body may have a replaceable battery or a rechargeable battery and thus may be combined with any type of recharging technology, including connection to a typical electrical outlet, connection to a car charger (i.e., cigarette lighter receptacle), and connection to a computer, such as through a universal serial bus (USB) cable. For example, an adaptor including a USB connector at one end and a control body connector at an opposing end is disclosed in U.S. Pat. Pub. No. 2014/0261495 to Novak et al., which is incorporated herein by reference in its entirety. Further, in some embodiments the cartridge may comprise a single-use cartridge, as disclosed in U.S. Pat. No. 8,910,639 to Chang et al., which is incorporated herein by reference in its entirety. As illustrated in FIG. 1, a control body 102 can be formed of a control body shell 101 that can include a control component 106 (e.g., a printed circuit board (PCB), an integrated circuit, a memory component, a microcontroller, or the like), a flow sensor 108, a battery 110, and an LED 112, and such components can be variably aligned. Further indicators (e.g., a haptic feedback component, an audio feedback component, or the like) can be included in addition to or as an alternative to the LED. Additional representative types of components that yield visual cues or indicators, such as light emitting diode (LED) components, and the configurations and uses thereof, are described in U.S. Pat. No. 5,154,192 to Sprinkel et al.; U.S. Pat. No. 8,499,766 to Newton and U.S. Pat. No. 8,539,959 to Scatterday; and U.S. patent application Ser. No. 14/173,266, filed Feb. 5, 2014, to Sears et al.; which are incorporated herein by reference.

A cartridge 104 can be formed of a cartridge shell 103 enclosing the reservoir 144 that is in fluid communication with a liquid transport element 136 adapted to wick or otherwise transport an aerosol precursor composition stored in the reservoir housing to a heater 134. Various embodiments of materials configured to produce heat when electrical current is applied therethrough may be employed to form the resistive heating element 134. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), titanium, platinum, silver, palladium, graphite and graphite-based materials (e.g., carbon-based foams and yarns) and ceramics (e.g., positive or negative temperature coefficient ceramics). As further described herein, a heater may comprise a variety of materials configured to provide electromagnetic radiation, including laser diodes.

An opening 128 may be present in the cartridge shell 103 (e.g., at the mouthend) to allow for egress of formed aerosol from the cartridge 104. Such components are representative of the components that may be present in a cartridge and are not intended to limit the scope of cartridge components that are encompassed by the present disclosure.

The cartridge 104 also may include one or more electronic components 150, which may include an integrated circuit, a memory component, a sensor, or the like. The electronic component 150 may be adapted to communicate with the control component 106 and/or with an external device by wired or wireless means. The electronic component 150 may be positioned anywhere within the cartridge 104 or its base 140.

Although the control component 106 and the flow sensor 108 are illustrated separately, it is understood that the control component and the flow sensor may be combined as an electronic circuit board with the air flow sensor attached directly thereto. Further, the electronic circuit board may be positioned horizontally relative the illustration of FIG. 1 in that the electronic circuit board can be lengthwise parallel to the central axis of the control body. In some embodiments, the air flow sensor may comprise its own circuit board or other base element to which it can be attached. In some embodiments, a flexible circuit board may be utilized. A flexible circuit board may be configured into a variety of shapes, include substantially tubular shapes.

The control body 102 and the cartridge 104 may include components adapted to facilitate a fluid engagement therebetween. As illustrated in FIG. 1, the control body 102 can include a coupler 124 having a cavity 125 therein. The cartridge 104 can include a base 140 adapted to engage the coupler 124 and can include a projection 141 adapted to fit within the cavity 125. Such engagement can facilitate a stable connection between the control body 102 and the cartridge 104 as well as establish an electrical connection between the battery 110 and control component 106 in the control body and the heater 134 in the cartridge. Further, the control body shell 101 can include an air intake 118, which may be a notch in the shell where it connects to the coupler 124 that allows for passage of ambient air around the coupler and into the shell where it then passes through the cavity 125 of the coupler and into the cartridge through the projection 141.

A coupler and a base useful according to the present disclosure are described in U.S. Pat. Pub. No. 2014/0261495 to Novak et al., the disclosure of which is incorporated herein by reference in its entirety. For example, a coupler as seen in FIG. 1 may define an outer periphery 126 configured to mate with an inner periphery 142 of the base 140. In one embodiment the inner periphery of the base may define a radius that is substantially equal to, or slightly greater than, a radius of the outer periphery of the coupler. Further, the coupler 124 may define one or more protrusions 129 at the outer periphery 126 configured to engage one or more recesses 178 defined at the inner periphery of the base. However, various other embodiments of structures, shapes, and components may be employed to couple the base to the coupler. In some embodiments the connection between the base 140 of the cartridge 104 and the coupler 124 of the control body 102 may be substantially permanent, whereas in other embodiments the connection therebetween may be releasable such that, for example, the control body may be reused with one or more additional cartridges that may be disposable and/or refillable.

The aerosol delivery device 100 may be substantially rod-like or substantially tubular shaped or substantially cylindrically shaped in some embodiments. In other embodiments, further shapes and dimensions are encompassed—e.g., a rectangular or triangular cross-section, multifaceted shapes, or the like.

The reservoir 144 illustrated in FIG. 1 can take on any design configured for retaining a liquid, such as a container or a mass configured for absorbing and/or adsorbing the liquid—e.g., a fibrous reservoir or a porous monolith, as presently described. As illustrated in FIG. 1, the reservoir 144 can comprise one or more layers of nonwoven fibers substantially formed into the shape of a tube encircling the interior of the cartridge shell 103. An aerosol precursor composition can be retained in the reservoir 144. Liquid components, for example, can be sorptively retained by the reservoir 144. The reservoir 144 can be in fluid connection with a liquid transport element 136. The liquid transport element 136 can transport the aerosol precursor composition stored in the reservoir 144 via capillary action to the heating element 134 that is in the form of a metal wire coil in this embodiment. As such, the heating element 134 is in a heating arrangement with the liquid transport element 136.

In use, when a user draws on the article 100, airflow is detected by the sensor 108, the heating element 134 is activated, and the components for the aerosol precursor composition are vaporized by the heating element 134. Drawing upon the mouthend of the article 100 causes ambient air to enter the air intake 118 and pass through the cavity 125 in the coupler 124 and the central opening in the projection 141 of the base 140. In the cartridge 104, the drawn air combines with the formed vapor to form an aerosol. The aerosol is whisked, aspirated, or otherwise drawn away from the heating element 134 and out the mouth opening 128 in the mouthend of the article 100.

An input element may be included with the aerosol delivery device. The input may be included to allow a user to control functions of the device and/or for output of information to a user. Any component or combination of components may be utilized as an input for controlling the function of the device. For example, one or more pushbuttons may be used as described in U.S. patent application Ser. No. 14/193,961, filed Feb. 28, 2014, to Worm et al., which is incorporated herein by reference. Likewise, a touchscreen may be used as described in U.S. patent application Ser. No. 14/643,626, filed Mar. 10, 2015, to Sears et al., which is incorporated herein by reference. As a further example, components adapted for gesture recognition based on specified movements of the aerosol delivery device may be used as an input. See U.S. patent application Ser. No. 14/565,137, filed Dec. 9, 2014, to Henry et al., which is incorporated herein by reference.

In some embodiments, an input may comprise a computer or computing device, such as a smartphone or tablet. In particular, the aerosol delivery device may be wired to the computer or other device, such as via use of a USB cord or similar protocol. The aerosol delivery device also may communicate with a computer or other device acting as an input via wireless communication. See, for example, the systems and methods for controlling a device via a read request as described in U.S. patent application Ser. No. 14/327,776, filed Jul. 10, 2014, to Ampolini et al., the disclosure of which is incorporated herein by reference. In such embodiments, an APP or other computer program may be used in connection with a computer or other computing device to input control instructions to the aerosol delivery device, such control instructions including, for example, the ability to form an aerosol of specific composition by choosing the nicotine content and/or content of further flavors to be included.

The various components of an aerosol delivery device according to the present disclosure can be chosen from components described in the art and commercially available. Examples of batteries that can be used according to the disclosure are described in U.S. Pat. Pub. No. 2010/0028766 to Peckerar et al., the disclosure of which is incorporated herein by reference in its entirety.

The aerosol delivery device can incorporate a sensor or detector for control of supply of electric power to the heat generation element when aerosol generation is desired (e.g., upon draw during use). As such, for example, there is provided a manner or method for turning off the power supply to the heat generation element when the aerosol delivery device is not be drawn upon during use, and for turning on the power supply to actuate or trigger the generation of heat by the heat generation element during draw. Additional representative types of sensing or detection mechanisms, structure and configuration thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; which are incorporated herein by reference.

The aerosol delivery device most preferably incorporates a control mechanism for controlling the amount of electric power to the heat generation element during draw. Representative types of electronic components, structure and configuration thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. and U.S. Pat. No. 8,205,622 to Pan; U.S. Pat. Pub. Nos. 2009/0230117 to Fernando et al., 2014/0060554 to Collett et al., and 2014/0270727 to Ampolini et al.; and U.S. patent application Ser. No. 14/209,191, filed Mar. 13, 2014, to Henry et al.; which are incorporated herein by reference.

Representative types of substrates, reservoirs or other components for supporting the aerosol precursor are described in U.S. Pat. No. 8,528,569 to Newton; U.S. Pat. Pub. Nos. 2014/0261487 to Chapman et al. and 2014/0059780 to Davis et al.; and U.S. patent application Ser. No. 14/170,838, filed Feb. 3, 2014, to Bless et al.; which are incorporated herein by reference. Additionally, various wicking materials, and the configuration and operation of those wicking materials within certain types of electronic cigarettes, are set forth in U.S. Pat. No. 8,910,640 to Sears et al.; which is incorporated herein by reference.

For aerosol delivery systems that are characterized as electronic cigarettes, the aerosol precursor composition most preferably incorporates tobacco or components derived from tobacco. In one regard, the tobacco may be provided as parts or pieces of tobacco, such as finely ground, milled or powdered tobacco lamina. In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine).

The aerosol precursor composition, also referred to as a vapor precursor composition, may comprise a variety of components including, by way of example, a polyhydric alcohol (e.g., glycerin, propylene glycol, or a mixture thereof), nicotine, tobacco, tobacco extract, and/or flavorants. Representative types of aerosol precursor components and formulations also are set forth and characterized in U.S. Pat. No. 7,217,320 to Robinson et al. and U.S. Pat. Pub. Nos. 2013/0008457 to Zheng et al.; 2013/0213417 to Chong et al.; 2014/0060554 to Collett et al.; 2015/0020823 to Lipowicz et al.; and 2015/0020830 to Koller, as well as WO 2014/182736 to Bowen et al, the disclosures of which are incorporated herein by reference. Other aerosol precursors that may be employed include the aerosol precursors that have been incorporated in the VUSE® product by R. J. Reynolds Vapor Company, the BLU™ product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC.

The amount of aerosol precursor that is incorporated within the aerosol delivery system is such that the aerosol generating piece provides acceptable sensory and desirable performance characteristics. For example, it is highly preferred that sufficient amounts of aerosol forming material (e.g., glycerin and/or propylene glycol), be employed in order to provide for the generation of a visible mainstream aerosol that in many regards resembles the appearance of tobacco smoke. The amount of aerosol precursor within the aerosol generating system may be dependent upon factors such as the number of puffs desired per aerosol generating piece. Typically, the amount of aerosol precursor incorporated within the aerosol delivery system, and particularly within the aerosol generating piece, is less than about 2 g, generally less than about 1.5 g, often less than about 1 g and frequently less than about 0.5 g.

Yet other features, controls or components that can be incorporated into aerosol delivery systems of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. Pub. Nos. 2010/0163063 to Fernando et al.; 2013/0192623 to Tucker et al.; 2013/0298905 to Leven et al.; 2013/0180553 to Kim et al., 2014/0000638 to Sebastian et al., 2014/0261495 to Novak et al., and 2014/0261408 to DePiano et al.; which are incorporated herein by reference.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure. Any of the elements shown in the article illustrated in FIG. 1 or as otherwise described above may be included in an aerosol delivery device according to the present disclosure.

In one or more embodiments, the present disclosure can relate to the use of a porous monolithic material in one or more components of an aerosol delivery device. As used herein, a "porous monolithic material" or "porous monolith" is intended to mean comprising a substantially single unit which, in some embodiments, may be a single piece formed, composed, or created without joints or seams and comprising a substantially, but not necessarily rigid, uniform whole. In some embodiments, a monolith according to the present disclosure may be undifferentiated, i.e., formed of a single material, or may be formed of a plurality of units that are permanently combined, such as a sintered conglomerate.

In some embodiments, the use of a porous monolith particularly can relate to the use of a porous glass in components of an aerosol delivery device. As used herein, "porous glass" is intended to refer to glass that has a three-dimensional interconnected porous microstructure. The term specifically can exclude materials made of bundles (i.e., wovens or non-wovens) of glass fibers. Thus, porous glass can exclude fibrous glass. Porous glass may also be referred to as controlled pore glass (CPG) and may be known by the trade name VYCOR®. Porous glass suitable for use according to the present disclosure can be prepared by known methods such as, for example, metastable phase separation in borosilicate glasses followed by liquid extraction (e.g., acidic extraction or combined acidic and alkaline extraction) of one of the formed phases, via a sol-gel process, or by sintering of glass powder. The porous glass particularly can be a high-silica glass, such as comprising 90% or greater, 95%, 96% or greater, or 98% or greater silica by weight. Porous glass materials and methods of preparing porous glass that can be suitable for use according to the present disclosure are described in U.S. Pat. No. 2,106,744 to Hood et al., U.S. Pat. No. 2,215,039 to Hood et al., U.S. Pat. No. 3,485,687 to Chapman et al., U.S. Pat. No. 4,657,875 to Nakashima et al., U.S. Pat. No. 9,003,833 to Kotani et al., U.S. Pat. Pub. No. 2013/0045853 to Kotani et al., U.S. Pat. Pub. No. 2013/0067957 to Zhang et al., U.S. Pat. Pub. No. 2013/0068725 to Takashima et al., and U.S. Pat. Pub. No. 2014/0075993 to Himanshu, the disclosures of which are incorporated herein by reference. Although the term porous "glass" may be used herein, it should not be construed as limiting the scope of the disclosure in that a "glass" can encompass a variety of silica based materials.

The porous glass can be defined in some embodiments in relation to its average pore size. For example, the porous glass can have an average pore size of about 1 nm to about 1000 μm, about 2 nm to about 500 μm, about 5 nm to about 200 μm, or about 10 nm to about 100 μm. In certain embodiments, porous glass for use according to the present disclosure can be differentiated based upon the average pore size. For example, a small pore porous glass can have an average pore size of 1 nm up to 500 nm, an intermediate pore porous class can have an average pore size of 500 nm up to 10 μm, and a large pore porous glass can have an average pore size of 10 μm up to 1000 μm. In some embodiments, a large pore porous glass can preferably be useful as a storage element, and a small pore porous glass and/or an intermediate pore porous glass can preferably be useful as a transport element.

The porous glass also can be defined in some embodiments in relation to its surface area. For example, the porous glass can have a surface area of at least 100 $m^2/g$, at least 150 $m^2/g$, at least 200 $m^2/g$, or at least 250 $m^2/g$, such as about 100 $m^2/g$ to about 600 $m^2/g$, about 150 $m^2/g$ to about 500 $m^2/g$, or about 200 $m^2/g$ to about 450 $m^2/g$.

The porous glass can be defined in some embodiments in relation to its porosity (i.e., the volumetric fraction of the material encompassed by the pores). For example, the porous glass can have a porosity of at least 20%, at least 25%, or at least 30%, such as about 20% to about 80%, about 25% to about 70%, or about 30% to about 60% by volume. In certain embodiments, a lower porosity may be desirable, such as a porosity of about 5% to about 50%, about 10% to about 40%, or about 15% to about 30% by volume.

The porous glass can be further defined in some embodiments in relation to its density. For example, the porous glass can have a density of 0.25 $g/cm^3$ to about 3 $g/cm^3$, about 0.5 $g/cm^3$ to about 2.5 $g/cm^3$, or about 0.75 $g/cm^3$ to about 2 $g/cm^3$.

In some embodiments, the use of a porous monolith particularly can relate to the use of a porous ceramic in components of an aerosol delivery device. As used herein, "porous ceramic" is intended to refer to a ceramic material that has a three-dimensional interconnected porous microstructure. Porous ceramic materials and methods of making porous ceramics suitable for use according to the present disclosure are described in U.S. Pat. No. 3,090,094 to Schwartzwalder et al., U.S. Pat. No. 3,833,386 to Frisch et al., U.S. Pat. No. 4,814,300 to Helferich, U.S. Pat. No. 5,171,720 to Kawakami, U.S. Pat. No. 5,185,110 to Kunikazu et al., U.S. Pat. No. 5,227,342 to Anderson et al., U.S. Pat. No. 5,645,891 to Liu et al., U.S. Pat. No. 5,750,449 to Niihara et al., U.S. Pat. No. 6,753,282 to Fleischmann et al., U.S. Pat. No. 7,208,108 to Otsuka et al., U.S. Pat. No. 7,537,716 to Matsunaga et al., U.S. Pat. No. 8,609,235 to Hotta et al., the disclosures of which are incorporated herein by reference. Although the term porous "ceramic" may be used herein, it should not be construed as limiting the scope of the disclosure in that a "ceramic" can encompass a variety of alumina based materials.

The porous ceramic likewise can be defined in some embodiments in relation to its average pore size. For example, the porous ceramic can have an average pore size of about 1 nm to about 1000 μm, about 2 nm to about 500 μm, about 5 nm to about 200 μm, or about 10 nm to about 100 μm. In certain embodiments, porous ceramic for use according to the present disclosure can be differentiated based upon the average pore size. For example, a small pore porous ceramic can have an average pore size of 1 nm up to 500 nm, an intermediate pore porous ceramic can have an average pore size of 500 nm up to 10 μm, and a large pore porous ceramic can have an average pore size of 10 μm up to 1000 μm. In some embodiments, a large pore porous ceramic can preferably be useful as a storage element, and a small pore porous ceramic and/or an intermediate pore porous ceramic can preferably be useful as a transport element.

The porous ceramic also can be defined in some embodiments in relation to its surface area. For example, the porous ceramic can have a surface area of at least 100 $m^2/g$, at least 150 $m^2/g$, at least 200 $m^2/g$, or at least 250 $m^2/g$, such as about 100 $m^2/g$ to about 600 $m^2/g$, about 150 $m^2/g$ to about 500 $m^2/g$, or about 200 $m^2/g$ to about 450 $m^2/g$.

The porous ceramic can be defined in some embodiments in relation to its porosity (i.e., the volumetric fraction of the material encompassed by the pores). For example, the porous ceramic can have a porosity of at least 20%, at least 25%, or at least 30%, such as about 20% to about 80%, about 25% to about 70%, or about 30% to about 60% by volume. In certain embodiments, a lower porosity may be desirable, such as a porosity of about 5% to about 50%, about 10% to about 40%, or about 15% to about 30% by volume.

The porous ceramic can be further defined in some embodiments in relation to its density. For example, the porous ceramic can have a density of 0.25 $g/cm^3$ to about 3 $g/cm^3$, about 0.5 $g/cm^3$ to about 2.5 $g/cm^3$, or about 0.75 $g/cm^3$ to about 2 $g/cm^3$.

Although silica-based materials (e.g., porous glass) and alumina-based materials (e.g., porous ceramic) may be discussed separately herein, it is understood that a porous monolith, in some embodiments, can comprise a variety of aluminosilicate materials. For example, various zeolites may be utilized according to the present disclosure.

A porous monolith used according to the present disclosure can be provided in a variety of sizes and shapes. Preferably, the porous monolith may be substantially elongated, substantially flattened or planar, substantially curved (e.g., "U-shaped"), substantially in the form of a walled cylinder, or in any other form suitable for use according to the present disclosure.

In one or more embodiments, a porous monolith according to the present disclosure can be characterized in relation to wicking rate. As a non-limiting example, wicking rate can be calculated by measuring the mass uptake of a known liquid, and the rate (in mg/s) can be measured using a microbalance tensiometer or similar instrument. Preferably, the wicking rate is substantially within the range of the desired mass of aerosol to be produced over the duration of a puff on an aerosol forming article including the porous monolith. Wicking rate can be, for example, in the range of about 0.05 mg/s to about 15 mg/s, about 0.1 mg/s to about 12 mg/s, or about 0.5 mg/s to about 10 mg/s. Wicking rate can vary based upon the liquid being wicked. In some embodiments, wicking rates as described herein can be referenced to substantially pure water, substantially pure glycerol, substantially pure propylene glycol, a mixture of water and glycerol, a mixture of water and propylene glycol, a mixture of glycerol and propylene glycol, or a mixture of water, glycerol, and propylene glycol. Wicking rate also can vary based upon the use of the porous monolith. For example, a porous monolith used as a liquid transport element may have a greater wicking rate than a porous monolith used as a reservoir. Wicking rates may be varied by control of one or more of pore size, pore size distribution, and wettability, as well as the composition of the material being wicked.

An exemplary embodiment of the present disclosure in relation to a porous monolith is illustrated in FIG. 2. As seen therein, a liquid transport element 236 is surrounded by and in contact with a reservoir 244.

In one or more embodiments, the porous monolith can comprise a porous glass. For example, either or both of the liquid transport element 236 and the reservoir 244 can be a porous glass as described herein. For exemplary purposes, both of the liquid transport element 236 and the reservoir 244 are formed of porous glass and, preferentially, they may each be formed of a different porous glass (i.e., a first porous glass and a second porous glass). In one or more embodiments, the first porous glass and the second porous glass can differ in one or more characteristics that can affect the storage and/or transport ability of the respective porous glass. For example, they may differ in one or more of density, porosity, surface area, and average pore size. The differential between the liquid transport element 236 and the reservoir 244 is sufficient to provide a wicking gradient wherein wicking ability is greater in the liquid transport element than in the reservoir. Such configuration may be characterized as a gradient porosity or a dual porosity configuration.

In further embodiments, the porous monolith can comprise a porous ceramic. As such, one or both of the liquid transport element 236 and the reservoir 244 may be formed of porous ceramic. Also, one of the liquid transport element 236 and the reservoir 244 may be formed of porous glass, and the other of the liquid transport element and the reservoir may be formed of porous ceramic. As such, the porous glass and the porous ceramic can have properties that are substantially matched to provide substantially identical flow characteristics, or the porous glass and the porous ceramic can have properties that are substantially different to provide substantially different flow characteristics.

A heater 234 is positioned relative to the liquid transport element 236 so as to be configured for vaporization of liquid aerosol precursor material that can be stored in the reservoir 244 and transported therefrom to the heater by the liquid transport element. The heater 234 can be, for example, a printed microheater, an annealed microheater, a flat ribbon heater, or any similar configuration suitable for vaporization of an aerosol precursor composition as otherwise described herein. The heater 234 may be in direct contact with the liquid transport element 236 or may be in a radiant heating configuration relative to the liquid transport element—i.e., in very close proximity to, but not directly touching the liquid transport element. As liquid aerosol precursor material is vaporized at the surface of the liquid transport element 236 due to heating by the heater 234, supplemental liquid may be wicked from the reservoir 244 to the proximity of the heater 234 by the liquid transport element and fill the area where the liquid was depleted by vaporization.

In some embodiments, one or more etchings (i.e., grooves or channels) may be present on one or both of the reservoir 244 and the liquid transport element 236. Although the grooves or channels may be formed by an etching process, use of the term "etchings" is not meant to be limiting of the process by which the grooves or channels are formed. As seen in FIG. 2, a first set of grooves 256 is etched into the liquid transport element 236 around the heater 234. The first set of grooves 256 is useful to limit direct contact of the liquid aerosol precursor composition with the heater 234. To this end, if desired, the porous monolith (particularly in the area of the heater) may be insulated, coated, or sealed to prevent the liquid aerosol precursor composition form coming into direct contact with the heater, which could function to damage the heater. In one or more embodiments, a second set of grooves 254 may be etched in the surface of the reservoir 244 so that the liquid aerosol precursor composition is substantially directed toward the central area of the heater where Joule heating is at a maximum. Although not illustrated, it is understood that the second set of grooves 254 may substantially align with and/or interconnect with the first set of grooves 256. Likewise, the presence of the second set of grooves 254 is not dependent upon the presence of the first set of grooves 256 and vice versa.

The combination of the heater 234, liquid transport element 236, and reservoir 244 may be characterized as an atomizer 20. In one or more embodiments, the reservoir 244 may be absent from the atomizer 20.

While the reservoir 244 and liquid transport element 236 are illustrated as separate elements, such separation is not required. In some embodiments, a single porous monolith substrate may be utilized and area treatments may provide for differentiation between a reservoir area and a liquid transport area.

Moreover, while the reservoir 244 and liquid transport element 236 are illustrated in FIG. 2 as being substantially planar, other shapes are also encompassed. For example, one or both of the reservoir and liquid transport element may independently be cylindrical, flat, oval-shaped, circular, square, rectangular, or the like. Preferentially, at least a portion of a surface of at least the liquid transport element is substantially flat to provide a location for placement of the heater. Such embodiments are exemplified in FIG. 3, wherein the reservoir 344 is substantially in the form of a half cylinder. The liquid transport element 336 is inset in the flat surface 344*a* of the reservoir; however, the liquid transport element may be layered on the flat surface of the reservoir. As seen in FIG. 3, the heater 334 is positioned on the liquid transport element 336, and etchings 356 are present in the liquid transport element.

An exemplary heater 434 is illustrated in FIG. 4, and such embodiments may particularly relate to so-called micro-heaters, such as described in U.S. Pat. Pub. No. 2014/0060554 to Collett et al., which is incorporated herein by reference. As illustrated in FIG. 4, the heater 434 can comprise a heater substrate 434*a* upon which a heater trace 434*b* is provided. The heater substrate 434*a* is preferably a chemically stable and heat-resistant material (e.g., silicon or glass), and the heater trace 434*b* can be a material suitable for rapid heating, such as a heating wire as otherwise described herein.

An atomizer 20 as illustrated in FIG. 2, for example, can be incorporated into a cartridge 104 as seen in FIG. 1. The atomizer 20 may be included in place of the heater 134, the liquid transport element 136, and optionally the reservoir 144. In some embodiments, the atomizer 20 may simply be included in addition to the further elements illustrated in FIG. 1.

In one or more embodiments, a porous monolith may be used as the liquid transport element alone. For example, as illustrated in FIG. 5, a cartridge 504 is formed of a shell 503 and a reservoir 544 that is holding a liquid aerosol precursor composition. The reservoir 544 may be a fibrous mat into which the liquid is absorbed or may be a container with suitable openings therein to receive the liquid transport element 536. The liquid transport element 536 is formed of a porous monolith and has respective ends 536*a* and 536*b* that extend into the reservoir 544. A heater 534 in the form of a resistive heating wire is wrapped around the liquid transport element 536 at an approximate middle section 536*c* thereof, and the wire includes terminals 535 for making an electrical connection with a power source. In some embodiments, the liquid transport element 536 can be a porous glass. In further embodiments, the liquid transport element 536 can be a porous ceramic. In one or more embodiments, one or both of the liquid transport element 536 and the reservoir 544 can be a porous glass, or one or both of the liquid transport element and the reservoir can be a porous ceramic. In some embodiments, one of the liquid transport element 536 and the reservoir 544 can be a porous glass, and the other of the liquid transport element and the reservoir can be a porous ceramic.

In some embodiments, a liquid transport element according to the present disclosure can be substantially in a core/shell form. As illustrated, for example, in FIG. 6, a core 636*a* can have at least a portion thereof surrounded with a shell 636*b*, which can be formed of a porous monolith. If desired, the core 636*a* may also be formed of a porous monolith. For example, the core 636*a* may be formed of a porous glass with one or more different properties from the porous glass forming the shell 636*b* so that differential characteristics of the combined elements may be provided. In particular, the core 636*a* may be formed of a porous glass configured for improved storage of a liquid, and the shell 636*b* may be formed of a porous glass configured for improved transport of the liquid for rapid wicking to the heater 634 that can be a wire that is substantially wrapped around the shell. In some embodiments, the core 636*a* may be formed of a material other than porous glass, such as a fibrous material. As non-limiting examples, the core 636*a* may be formed of a glass fiber, cotton, cellulose acetate, or like materials. In some embodiments, one or both of the core 636*a* and the shell 636*b* can be formed of a porous ceramic. In further embodiments, one of the core 636*a* and the shell 636*b* can be formed of a porous glass, and the other of the core and the shell can be formed of a porous ceramic.

As illustrated in FIG. 6, the porous monolith shell 636*b* has opposing ends 636*b*' and 636*b*", and the core 636*a* is sized so that it extends beyond the opposing ends of the porous monolith shell. One or both of the ends 636*a*' and 636*a*" of the core 636*a* can be positioned in an aerosol delivery device so as to extend into a reservoir (e.g., a fibrous mat or a bulk liquid storage container) and thus wick liquid to the shell 636*b* so that the liquid is vaporized by the heater 634. As before, the heater 634 can include terminals 635 for making an electrical connection with a power source. Such core/shell design can be particularly beneficial in that the core material can be shielded from potential scorching by the high heat provided by the heating wire. Likewise, in use, air flow for entraining formed vapor may pass substantially across the porous monolith shell and have little or substantially no direct flow across the core material.

The combination of elements in FIG. 6 may be characterized collectively as an atomizer 60. Nevertheless, it is understood that one or more of the elements (e.g., the core 636*a* and/or the shell 636*b* and/or the heater 634) may be utilized separate from the unit in combination with one or more further embodiments described herein.

In one or more embodiments, a porous monolith can be used as a reservoir that can be substantially shaped as a cylinder. For example, FIG. 7*a* and FIG. 7*b* illustrate an atomizer 70 comprising a reservoir 744 formed of a porous monolith that is shaped as a cylinder. The reservoir 744 has a wall 745 with a thickness that can vary, and a central opening 746 is defined by the wall. A liquid transport element 736 is configured with a central portion 736*c* and respective end portions 736*a*' and 736*a*" extending away from the central portion. The respective end portions 736*a*' and 736*a*" are configured to be in fluid connection with the wall 745 of the reservoir 744. One or both of the liquid transport element 736 and the reservoir 744 can be formed of a porous glass. For example, the liquid transport element 736 may be formed of porous glass with one or more properties that are different from the properties of the porous glass forming the reservoir 744. In some embodiments, the liquid transport element 736 can be formed of a fibrous material and thus may be referred to as a fibrous wick. A heater 734 in the form of a wire is wrapped around the central portion 736*c* of the liquid transport element 736 can include terminals 735 for making an electrical connection with a power source. In one or more embodiments, one or both of the liquid transport element 736 and the reservoir 744 can be formed of a porous ceramic. In some embodiments, one of the liquid transport element 736 and the reservoir 744 can be formed of a porous glass, and the other of the liquid transport element and the reservoir can be formed of a porous ceramic.

In some embodiments, the reservoir wall 745 can include one or more grooves 744*a*. The respective end portions 736*a*' and 736*a*" of the liquid transport element 736 in particular may engage the reservoir 744 in the grooves 744*a*. If desired, the grooves 744*a* can be configured to have one or more properties that are different that the remaining sections of the reservoir, such as having a different porosity. In this manner, liquid stored in the reservoir 744 can be preferentially directed toward the grooves 744*a* to be taken up by the liquid transport element 736 for delivery to the heater 734.

Although the elements in FIG. 7*a* and FIG. 7*b* are illustrated as a unit forming an atomizer 70, it is understood that one or more of the elements (e.g., the reservoir 744 and/or the liquid transport element 736 and/or the heater 734) may be utilized separate from the unit in combination with one or more further embodiments described herein.

In one or more embodiments, a porous monolith forming a liquid transport element can have a heating member contained therein. For example, as illustrated in FIG. 8, a cartridge 804 is formed of a shell 803 and a reservoir 844 that is holding a liquid aerosol precursor composition. The reservoir 844 may be a fibrous mat into which the liquid is absorbed or may be a walled container with suitable openings therein to receive the liquid transport element 836. The liquid transport element 836 is formed of a porous monolith and has respective ends 836*a* and 836*b* that extend into the reservoir 844. A heater 834 in the form of a resistive heating wire is positioned within the liquid transport element 836, and the wire includes terminals 835 for making an electrical connection with a power source. A flow tube 839 is included and can be useful for directing air across the liquid transport element 836 so that vapor evolved by internal heating of the liquid transport element by the heater 834 becomes entrained in the air to form an aerosol that can be withdrawn by a consumer. In some embodiments, the liquid transport element 836 can be a porous glass. In further embodiments, the liquid transport element 836 can be a porous ceramic. In one or more embodiments, one or both of the liquid transport element 836 and the reservoir 844 can be a porous glass, or one or both of the liquid transport element and the reservoir can be a porous ceramic. In some embodiments, one of the liquid transport element 836 and the reservoir 844 can be a porous glass, and the other of the liquid transport element and the reservoir can be a porous ceramic. Further, the liquid transport element 844 can be a porous glass or a porous ceramic, and the reservoir 844 can be a fibrous mat or a storage container.

The heater 834 can be included within the liquid transport element 836 in a variety of manners. In some embodiments, the heater can be embedded within the porous monolith. For example, the porous monolith can be formed with the heater in place so that the heater is substantially entrapped within the liquid transport element. In the illustration of FIG. 9*a*, for example, the heater 934 is embedded in the liquid transport element 936, and an end of the heater extends out from the liquid transport element to make electrical connection with the terminals (see element 835 in FIG. 8). In some embodiments, the porous monolith can be hollow, can be substantially in the form or a tube, can have a slot, channel, or the like formed therein, or can otherwise include a void into which the heater is place so as to be substantially internal to the liquid transport element. For example, in FIG. 9*b*, the liquid transport element 936 is a hollow tube, and the heater 934 is positioned within a cavity 937 of the hollow tube. In FIG. 9*c*, for example, the liquid transport element 936 includes a cavity 937 substantially in the form of a channel along at least a portion of the length of the liquid transport element, and the heater 934 is positioned in the cavity.

In one or more embodiments, the heater that is internal to the liquid transport element can be in direct contact with at least a portion of the liquid transport element so as to provide conductive heating thereof. In one or more embodiments, the heater that is internal to the liquid transport element can be substantially, predominately, or approximately completely in a radiative heating relationship with the liquid transport element. A substantially radiative heating relationship can mean that radiative heating occurs but does not provide a majority of the heating—e.g., 50% or less of the heating is radiative heating but a measurable quantity of the heating is radiative. A predominately radiative heating relationship can mean that radiative heating provides a majority of the heating but not all of the heating—i.e., greater than 50% of the heating is radiative. An approximately complete radiative heating relationship can mean that at least 90%, preferably at least 95%, and more preferably at least 98% or at least 99% of the heating is radiative.

In some embodiments, the present disclosure further can provide for methods of preparing an aerosol delivery device or a component useful in an aerosol delivery device. Such methods can include providing a porous monolith in the form of a reservoir and/or in the form of a liquid transport element, and combining the porous monolith reservoir and/or liquid transport element with a heater and optionally with one or more further components described herein as being useful in an aerosol delivery device. One or both of the reservoir and the liquid transport element can be a porous glass. One or both of the reservoir and the liquid transport element can be a porous ceramic. One of the reservoir and the liquid transport element can be a porous glass, and the other of the reservoir and the liquid transport element can be a porous ceramic. In one or more embodiments, one of the reservoir and the liquid transport element can be a fibrous material.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

an outer housing;

a reservoir containing a liquid, wherein the reservoir is formed of porous glass, the reservoir having a wall;

a heater configured to vaporize the liquid; and a liquid transport element configured to provide the liquid to the heater, wherein the liquid transport element is a fibrous wick, wherein one or more portions of the fibrous wick are in fluid connection with the reservoir wall, wherein the reservoir wall includes one or more grooves, and wherein the one or more grooves have a porosity that is different from the porosity of the remaining portions of the reservoir wall.

2. The aerosol delivery device according to claim 1, wherein the heater is printed on the liquid transport element or annealed to the liquid transport element.

3. The aerosol delivery device according to claim 1, wherein the heater is in a radiant heating arrangement with the liquid transport element.

4. The aerosol delivery device according to claim 1, wherein at least a portion of the liquid transport element is substantially planar, and wherein the heater is at least partially positioned on the substantially planar portion of the liquid transport element.

5. The aerosol delivery device according to claim 1, wherein the porous glass comprises one or more etchings.

6. The aerosol delivery device according to claim 1, wherein the reservoir is substantially shaped as a cylinder having a wall.

7. The aerosol delivery device according to claim 6, wherein the reservoir is substantially shaped as a hollow cylinder.

8. The aerosol delivery device according to claim 1, wherein the outer housing comprises an air entry and comprises a mouthend with an aerosol port.

9. The aerosol delivery device according to claim 1, wherein the device further comprises one or more of an electrical power source, a pressure sensor, and a microcontroller.

10. The aerosol delivery device according to claim 9, wherein one or more of the electrical power source, the pressure sensor, and the microcontroller are positioned within a separate control housing that is connectable with the outer housing.

11. An atomizer comprising:

a vapor substrate formed of a porous monolith and configured for transport of a liquid aerosol precursor composition;

a reservoir formed of a porous monolith connected to the vapor substrate; and a heater in a heating arrangement with the vapor substrate, wherein at least a portion of the heater is internal to and in direct contact with at least a portion of the vapor substrate.

12. The atomizer according to claim 11, wherein the vapor substrate has a first porosity, and the reservoir has a second porosity that is different form the first porosity.

13. The atomizer according to claim 11, wherein one or both of the vapor substrate and the reservoir includes one or more etchings.

14. The atomizer according to claim 11, wherein:

one or both of the vapor substrate and the reservoir is a porous glass;

one or both of the vapor substrate and the reservoir is a porous ceramic; or one of the vapor substrate and the reservoir is a porous glass, and the other of the vapor substrate and the reservoir is a porous ceramic.

15. The atomizer according to claim 11, wherein the porous monolith is a porous glass or a porous ceramic.

16. The atomizer according to claim 11, wherein the vapor substrate is substantially planar.

17. The atomizer according to claim 11, wherein the vapor substrate is substantially in the form of a hollow tube or the vapor substrate includes a channel formed therein.

* * * * *